United States Patent [19]

Conrad

[11] Patent Number: 4,702,190

[45] **Date of Patent: * Oct. 27, 1987**

[54] STRUCTURAL SAIL WITH GRID MEMBERS

[75] Inventor: Peter G. Conrad, Old Lyme, Conn.

[73] Assignee: Sobstad Sailmakers, Inc., Old Saybrook, Conn.

[ * ] Notice: The portion of the term of this patent subsequent to Nov. 25, 2003 has been disclaimed.

[21] Appl. No.: 809,160

[22] Filed: Dec. 14, 1985

Related U.S. Application Data

[63] Continuation-in-part of Ser. No. 681,933, Dec. 14, 1984, Pat. No. 4,593,639, and a continuation-in-part of Ser. No. 722,268, Apr. 11, 1985, and a continuation-in-part of Ser. No. 791,776, Oct. 28, 1985, Pat. No. 4,624,205.

[51] Int. Cl.[4] ..... B63H 9/06

[52] U.S. Cl. ..... 114/103

[58] Field of Search ..... 114/39, 102, 103, 109

[56] References Cited

U.S. PATENT DOCUMENTS

| | | | |
|---|---|---|---|
| 3,756 | 9/1844 | Trail | 114/103 |
| 2,378,877 | 6/1945 | Waller | 114/103 |
| 2,620,760 | 12/1952 | Melges | 114/103 |
| 2,796,038 | 6/1957 | Pegel et al. | 114/103 |
| 3,053,219 | 9/1962 | Coon | 114/103 |
| 3,274,968 | 9/1966 | Hayes et al. | 114/103 |
| 3,356,059 | 12/1967 | Ross | 114/103 |
| 3,954,076 | 5/1976 | Fracker | 114/103 |

OTHER PUBLICATIONS

Watts, Sails by, Yachting Jan. 1963, 114–103.

*Primary Examiner*—Jeffrey V. Nase
*Assistant Examiner*—Stephen P. Avila
*Attorney, Agent, or Firm*—Fred A. Keire

[57] ABSTRACT

An improved structural sail with grid members appropriately positioned to resist aerodynamic loads.

10 Claims, 3 Drawing Figures

PANEL #5
PANEL #4
PANEL #3
PANEL #2
PANEL #1
11
10a
34
90
24
37
91
9
26
16
5
19
31
78
77
78'
77'
79
41
75'
74'
22
76
12
17
14

STRUCTURAL SAIL WITH GRID MEMBERS

This application is a continuation-in-part of U.S. patent application Ser. No. 06/681,933 filed Dec. 14, 1984 now U.S. Pat. No. 4,593,639; 06/722,268 filed Apr. 11, 1985, and now U.S. Pat. No. 4,624,205 and 06/791,776 filed Oct. 28, 1985.

FIELD OF INVENTION

This invention relates to a lifting surface, more particularly a structural sail. Further, this invention relates to a sail that has structural members on the skin of it or within it to accomodate point load and aerodynamic load distribution in the sail. Still further, this invention relates to a sail that has an improved aerodynamic load distribution.

BACKGROUND FOR THE INVENTION

In my previous U.S. Pat. Nos. 4,593,639 and 4,624,205, I had disclosed various structural member or grid member and structural member arrangements for a sail, including various grid member arrangements in a sail, such as for a mainsail and for a Genoa sail. In this application I disclose further highly unexpected developments as the result of my previously discovered sails and arrangements of grid and structural members on a sail.

BRIEF DESCRIPTION OF THE INVENTION

It has now been found that the cross grid members disclosed in my previous application, when used in a sail in combination with the skin member for the sail, improve the constructural aspects of the sail still further. Moreover, the structural strength of the sail is improved over conventional sails and allows the sail to be used with considerably less aerodynamic load distention caused by the loads imposed on these sails. At the same time, the sail may be used in lighter materials over wider wind ranges, or for the same skin member material higher safe wind ranges are achieved.

For example, it has now been found that the cross grid members as shown in my previous application may be used with great advantage in combination with the proper panel layout and without the structural members running along the leech and the luff of the sail. This serendipitous discovery arose as various sails were tried with a progressively increasing number of structural members being added thereto. It has been found in use that the cross grid members disclosed in my previous application, when used in a proper layout and in a proper distribution on the sail, improve significantly the sail behavior such as for Genoas and mainsails.

INCORPORATION BY REFERENCE HEREIN

The disclosures in my previous three applications mentioned above are also incorporated by reference herein for ease of understanding of the various embodiments to which the present invention may be applicable.

DESCRIPTION OF THE DRAWINGS AND DESCRIPTION OF THE INVENTION HEREIN

With reference to the drawing, the same items shown in my previous application, when applicable, are illustrated by the same numbers, wherein.

Figure 1:
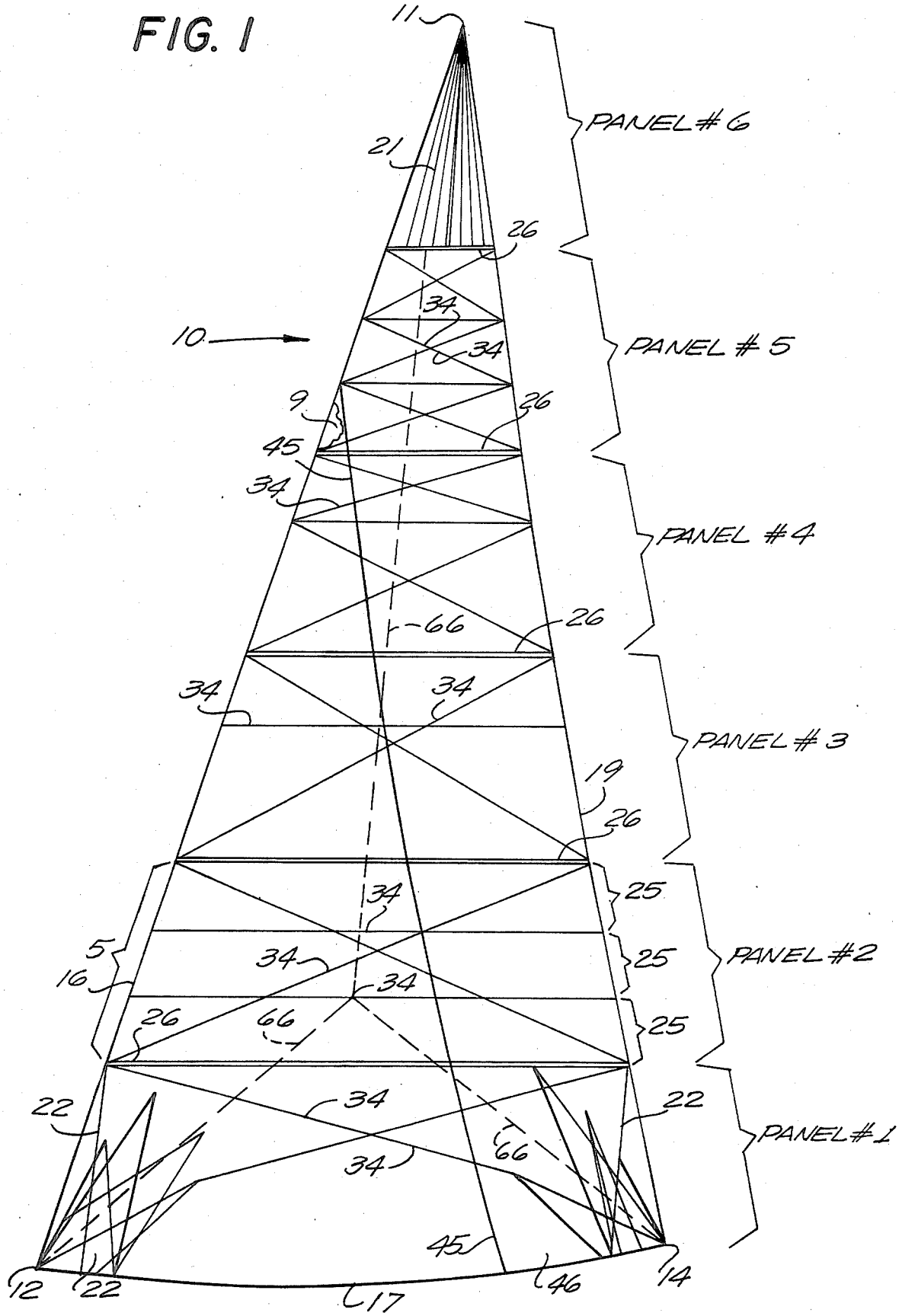
FIG. 1 illustrates in a plan view a typical jib or Genoa sail without its skin members, but with the structural and grid members according to the presently disclosed improvement.

In accordance with the present invention, the sail 10 shown in the FIG. 1 has a skin 9, a head 11, a tack 12, a clew 14, a luff 16, a foot 17 and a leech 19. The sail has head reinforcements shown as 21, which are a number of panels radiating out from the point load at the apex of the sail. These panels may be either on one or both sides of the sail. Similarly, point load locations of the clew 14 and the tack 12 have reinforcement panels 22 of a similar construction.

Further, in accordance with the present improvements as shown in the FIG. 1, the sail is again constructed in the manner as shown and discussed in my previous applications, such as by individual panel construction, which panels have been illustrated in the FIG. 1 as ranging from Panels #1 to #6. Although the present panel illustration is fairly typical, it is by no means the only panel layout possible. The present invention applies equally well to any panel layout, as the improvement addresses the aerodynamic loads imposed on any panel layout.

For illustrative purposes, the previously adopted panel layouts are shown, that is, ranging from Panels #1 to #6. Typically, each of the panels may also consist of subpanels, such as shown for Panel #2 where the subpanels have been indicated by numeral 25. Thus the entire Panel #2 has been shown as comprising of three subpanels. For additional load distribution and also leech reinforcement, a ply 46 has been shown running from the foot 17 of the sail to the luff of the sail into Panel #5 as shown in the FIG. 1.

Each of the panels as shown in the FIGURE is joined with a structural member 26 as a means for joining the panels. These structural members may also be omitted.

Each panel, however, is now laid out with a number of cross grid members identified as 34. These cross grid members 34 may run from one corner to a panel on the leech 19 to another corner of the panel at the luff 16 for the sail.

As shown for Panel #2, the cross grid members 34 may be running about parallel to the foot 17 (about horizontal to water) of the sail, and thus in Panel #2 there are altogether four cross grid members.

Further, in Panel #3 there are three cross grid members 34, one running about parallel to the foot of the sail and the others running from one corner to the other corner of the sail diagonally across thereof.

Thus the two diagonal cross grid members 34 cooperate with the horizontal grid member.

Although various arrangements have been shown, such as for Panels #2 and #3, the cross grid member 34 layout may vary considerably. These cross grid members 34 do not necessarily have to be diagonally across the entire panel as long as there is some intertying of the horizontal and diagonal grid members and some of the grid members run from luff to leech.

Further, the number of cross grid members 34 running about parallel to the foot, and the cross grid members diagonally across the panels may be of various weight combinations to accomodate the load in the various panels as previously discussed in my previous application.

It is fairly necessary, however, that the number of cross grid panels 34, especially towards the head 11 of the sail, be increased in number and frequency, as the stress is considerably greater at the top of the sail towards the point load location.

Consequently, the layout such as for Panels #4 and #5 illustrates a typical cross grid member layout found to be advantageous for a medium to heavy weight sail.

Figure 2:
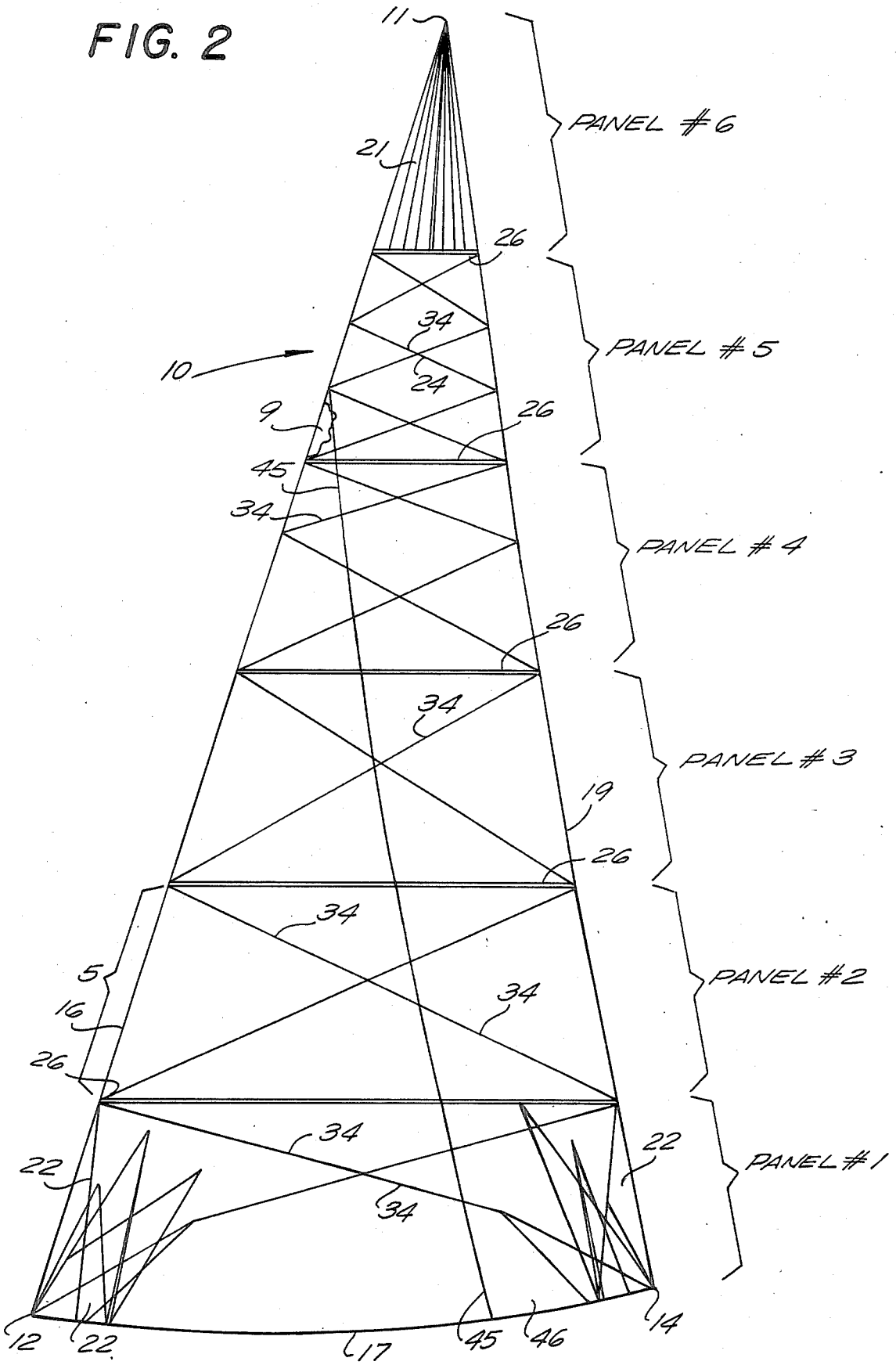
FIG. 2 illustrates in a plan view a typical jib or Genoa sail as another embodiment without its skin members but with diagonal grid members according to another disclosed improvement.

In FIG. 2 the panel layout and the diagonal cross grid members have been shown without the horizontal grid members, that is, the grid members which are substantially parallel to the foot of the sail. The other sail elements illustrated in FIG. 2 are identified with the same numerals as shown for the sail elements in FIG. 1.

Figure 3:
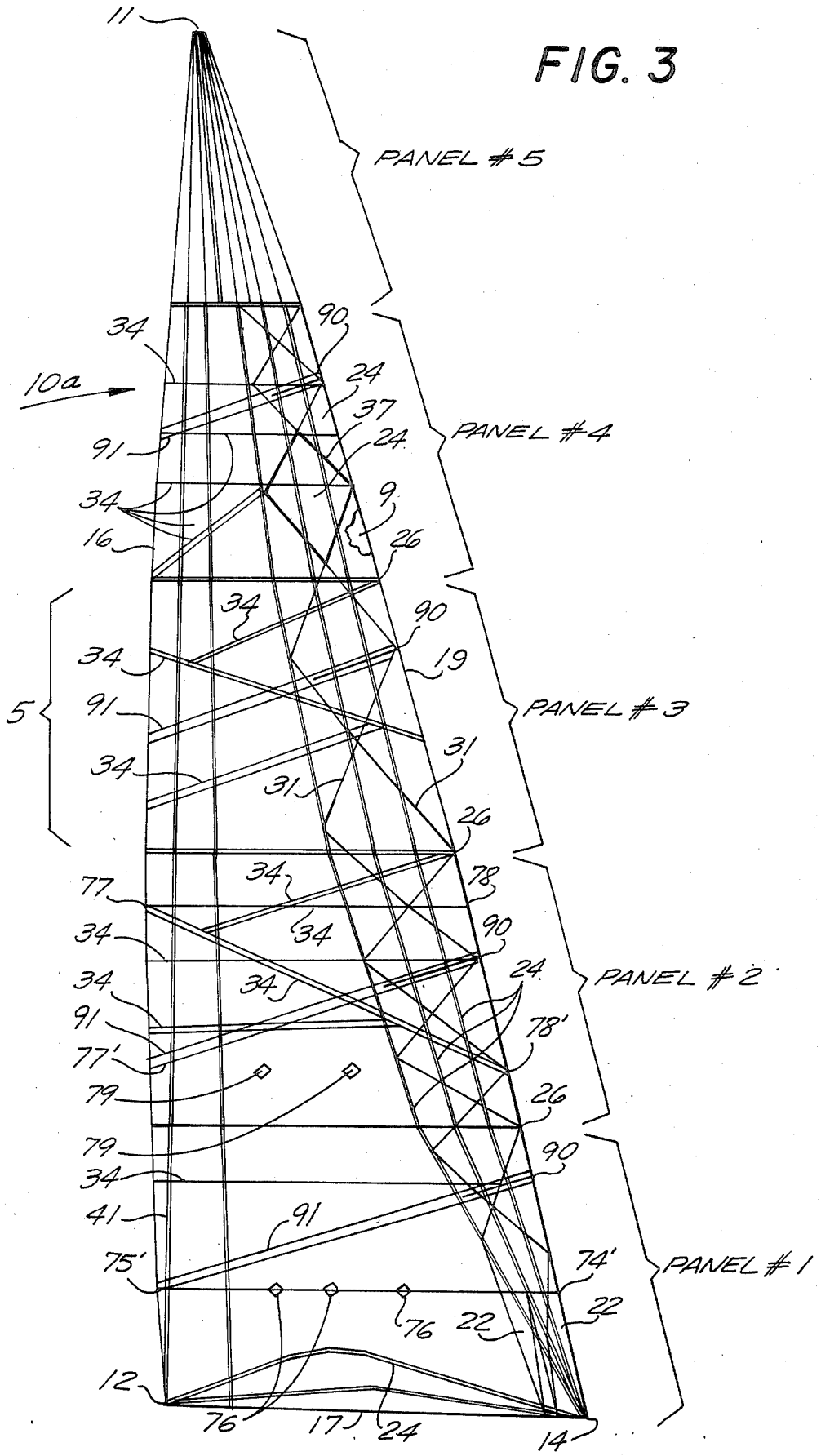
FIG. 3 illustrates in a plan view a typical mainsail as a further embodiment. The skin member has not been shown, but various grid member arrangements are illustrated.

In the same manner as illustrated in the FIGS. 1 and 2, a mainsail 10*a* is exemplified shown herein as FIG. 3; mainsail 10*a* is likewise constructed with the cross grid members 34 being further supplemented such as by grid strips overlaying battens 90. Similarly, for the mainsail a ply 46 (not shown in in FIG. 3; apropriately illustrated in FIG. 1) may likewise run from the clew 14 of the sail to the luff area approximately more than halfway or two-thirds of the way up the luff or one-third the luff distance from the head.

In the FIG. 3 mainsail, the other members of the sail are in addition to those shown for the FIG. 1 or FIG. 2 sail, e.g., corner patches, etc. Additional corners and their construction are intoduced for first reef tack 75' and clew 74', second reef tack 77' and clew 78', and third reef tack 77 and clew 78. Reef points have been shown as 76 and 79 for the first and second reef, respectively.

Moreover, battens 90 are shown, and a typical batten pocket (constructed in a typical manner) and not shown, have been overlaid with a batten structural member 91 of Kevlar material of Mylar-Kevlar on one or both sides of the sail, preferably across the whole width of the sail and from leech 19 across roach 81 to the luff 16 of the sail.

In this manner, the batten structural member 91 becomes a structural member akin to stuctural member 26, yet serves for a batten pocket reinforcement and performs two functions without requiring an expensive reinforcement for a batten 90, i.e., batten pocket inner end or outer end reinforcement patch or patches (not shown).

optional secondary, vertical grid members have been shown as 41.

In the illustration as shown, the panels may be of Dacron-Mylar laminates; Dacron-Kevlar woven material with a Mylar laminate; Kevlar-Mylar laminates; scrimmed Kevlar-Mylar laminates, and Spectra 900 and Spectra 1000 laminates with Mylar. (Spectra 900 and Spectra 1000 are trademarked polyolefin polymer fibers by Allied Corporation, Morristown, N.J.)

Of the above-mentioned materials, for the skin 9 and grid member 34 construction, these may be one-sided laminates, that is, with the woven material on one side of the laminate and the Mylar or like polymer laminate on the other side, or these may be two-sided laminates, that is, with Mylar on both sides with the Kevlar, etc. material in the middle, or these may also be two-sided woven materials with a Mylar film inbetween. Laminated monofilament yarns, nonwoven but oriented in principal stress directions, may also be used.

For a typical 12 meter boat jib sail (Genoa) used up to 32 knots true wind, the sail is constructed in six panels as shown in the FIG. 1, but each of the panels had a different skin layout. The dashed lines 66 indicate the material in panel areas towards leech, luff and foot. This type of construction is called a "tri-radial" construction.

For the leech area, defined by the dashed lines 66 and 19, a 7.5 ounce per sailmaker's yard Kevlar-Mylar laminate with 3 mil Mylar film is used. The Kevlar woven material is of 400 denier threads with 10 per inch of the threads being 1000 denier Kevlar. The same material is also used in the luff section of Panels #5 and #6 and the luff section of foot Panel #6.

For the luff section of Panels #2, #3 and #4 (left of the dashed line 66 between luff 16), the material is Dacron and Kevlar cloth with 2 mil Mylar film.

The Mylar-Kevlar laminate is 4.2 ounces per sailmaker's yard.

The foot section is Dacron-Mylar laminate of 2 mil Mylar and 840 denier Dacron of 5.5 ounces per sailmaker's yard.

The grid members 34 are of 400 denier woven non-laminated material adhesively attached to the sail and then sewn on. These are about three inches wide. The foot patches 22 and the head patches 21 are 400 denier Kevlar woven material with 2 mil Mylar of about 5.5 ounces per sailmaker's yard.

The seam straps 26 may also be omitted.

For a mainsail for a 40 foot boat, the mainsail is of similar tri-radial construction as for the Genoa jib described above. The leech area, however, is of 400 denier Kevlar woven material with 2 mil Mylar laminated to it with the material being 5.5 ounces per sailmaker's yard. The front part, i.e., the luff section, is a Dacron-Kevlar cloth laminated to 2 mil Mylar film, and the laminate is 4.2 ounces per sailmaker's yard. The foot section is Dacron-Mylar laminate of 2 mil Mylar and 840 denier Dacron of 5.5 ounces per sailmaker's yard.

The grid members 34 are of 400 denier woven non-laminated material adhesively attached to the sail and then sewn on. These are typically about two inches wide. If the leech structural members disclosed in my application Ser. No. 06/791,776 filed Oct. 28, 1985 are used, then the grid members 34 run only to the forward innermost structural member. If no structural members are used, then grid members run from luff to leech, the same as shown in the FIG. 1 for the jib sail.

Although these values have been given as an illustration, lesser strength materials, that is, materials made of smaller denier yarn, such as for Kevlar, may be used in wider widths. Conversely, for heavier denier materials, narrower width members may be employed.

Similarly, the width of the cross grid members 34 may vary from panel to panel, as well as the denier weight, as found by experience and based on the stress distribution values encountered in a sail.

Likewise, the sail 10 or 10*a* may be used without the ply 46 and/or other ply layouts may be used with a different combination of grid arrangements, as it is within the scope of this invention to employ all arrangements of the disclosed members in the various forms and functions as these are within the scope of the present invention.

What is claimed is:

1. As an article of manufacture, a sail, wherein the same comprises a continuous skin member a plurality of panels, including a plurality of corners for said sail; a plurality of pliant grid members in strip form across said panels adheringly and integrally attached to said skin member, said grid members integrally interconnecting with grid members of at least one adjoining panel, said grid members defining a latticework pattern on said skin member, said latticework interconnectingly adjoining a latticework on an adjacent panel, said rid members in said latticework pattern interlockingly bearing a part of a load exerted on said sail and running substantially from luff to leech or from leech to luff.

2. The sail as defined in claim 1, wherein the sail has a skin member of a plurality of panels and wherein the sail has cross grid members on said skin member at increased frequency towards the head thereof.

3. The sail as defined in claim 1, wherein the sail has only cross grid members from one corner of a panel to another corner of a panel.

4. The sail as defined in claim 1, wherein the sail is free of cross grid members about parallel to the foot of the sail.

5. The sail as defined in claim 1, wherein the sail includes cross grid members short of the leech.

6. The sail as defined in claim 1, wherein the sail is a Genoa sail which has a skin member of a plurality of panels and wherein the sail has cross grid members on said skin member, said cross grid members extending over individual panels and interlocking at least two panels.

7. the sail as defined in claim 1, wherein the sail is a mainsail which has only cross grid members from one corner of a panel to another corner of a panel.

8. The sail as defined in claim 1, wherein the sail is a mainsail and is free of cross grid members about parallel to the foot of the sail.

9. The sail as defined in claim 8, wherein the sail includes cross grid members short of the leech.

10. The sail as defined in claim 8 wherein the sail has a plurality of structural members along the leech and said grid members run to the innermost structural member closest to the luff.

* * * * *